US009830904B2

(12) United States Patent
Nasu et al.

(10) Patent No.: US 9,830,904 B2
(45) Date of Patent: Nov. 28, 2017

(54) TEXT-TO-SPEECH DEVICE, TEXT-TO-SPEECH METHOD, AND COMPUTER PROGRAM PRODUCT

(71) Applicant: KABUSHIKI KAISHA TOSHIBA, Minato-ku, Tokyo (JP)

(72) Inventors: Yu Nasu, Tokyo (JP); Masatsune Tamura, Kanagawa (JP); Ryo Morinaka, Tokyo (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/185,259

(22) Filed: Jun. 17, 2016

(65) Prior Publication Data

US 2016/0300564 A1 Oct. 13, 2016

Related U.S. Application Data

(63) Continuation of application No. PCT/JP2013/084356, filed on Dec. 20, 2013.

(51) Int. Cl.
*G10L 13/00* (2006.01)
*G10L 13/10* (2013.01)
(Continued)

(52) U.S. Cl.
CPC ..... *G10L 13/10* (2013.01); *G10L 13/033* (2013.01); *G10L 13/06* (2013.01)

(58) Field of Classification Search
USPC ..... 704/258–269
See application file for complete search history.

(56) References Cited

U.S. PATENT DOCUMENTS 5,327,521 A * 7/1994 Savic ..... G10L 21/00 704/200
6,032,111 A * 2/2000 Mohri ..... G06F 17/2755 704/257
(Continued)

FOREIGN PATENT DOCUMENTS

| | | | |
|---|---|---|---|
| JP | 2008-191525 | A | 8/2008 |
| JP | 2011-028130 | A | 2/2011 |
| JP | 2011-028131 | A | 2/2011 |
| JP | 2011-242470 | A | 12/2011 |
| JP | 2013-190792 | A | 9/2013 |

OTHER PUBLICATIONS

English Translation of the Written Opinion dated Feb. 10, 2014 as received in corresponding PCT Application No. PCT/JP2013/084356.

(Continued)

*Primary Examiner* — Abul Azad
(74) *Attorney, Agent, or Firm* — Foley & Lardner LLP

(57) ABSTRACT

According to an embodiment, a text-to-speech device includes a context acquirer, an acoustic model parameter acquirer, a conversion parameter acquirer, a converter, and a waveform generator. The context acquirer is configured to acquire a context sequence affecting fluctuations in voice. The acoustic model parameter acquirer is configured to acquire an acoustic model parameter sequence that corresponds to the context sequence and represents an acoustic model in a standard speaking style of a target speaker. The conversion parameter acquirer is configured to acquire a conversion parameter sequence corresponding to the context sequence to convert an acoustic model parameter in the standard speaking style into one in a different speaking style. The converter is configured to convert the acoustic model parameter sequence using the conversion parameter sequence. The waveform generator is configured to generate a voice signal based on the acoustic model parameter sequence acquired after conversion.

14 Claims, 7 Drawing Sheets

(51) Int. Cl.
*G10L 13/06* (2013.01)
*G10L 13/033* (2013.01)

(56) References Cited

U.S. PATENT DOCUMENTS

| | | | | |
|---|---|---|---|---|
| 7,096,183 | B2 | 8/2006 | Junqua | |
| 8,340,965 | B2 * | 12/2012 | Yan | G10L 13/08 704/256.3 |
| 9,570,066 | B2 * | 2/2017 | Talwar | G10L 13/08 |
| 2003/0163320 | A1 * | 8/2003 | Yamazaki | G10L 13/10 704/270 |
| 2007/0276666 | A1 * | 11/2007 | Rosec | G10L 13/07 704/260 |

OTHER PUBLICATIONS

Latorre et al., "Speech factorization for HMM-TTS based on cluster adaptive training." in Proc. Interspeech, 2012, 4 pages.

Yamagishi et al., "Acoustic Modeling of Speaking Styles and Emotional Expressions in HMM-Based Speech Synthesis," IEICE Trans on If. & Syst., vol. E88-D, No. 3, 2005, pp. 502-509.

Yamagishi et al., "Speaker adaptation using context clustering decision tree for HMM-based speech synthesis", IEICE Technical Report, The Institute of Electronics, Information and Communication Engineers, Aug. 15, 2003, pp. 31-36 with English Abstract.

* cited by examiner

TEXT-TO-SPEECH DEVICE, TEXT-TO-SPEECH METHOD, AND COMPUTER PROGRAM PRODUCT

CROSS-REFERENCE TO RELATED APPLICATION

This application is a continuation of PCT international Application Ser. No. PCT/JP2013/084356, filed on Dec. 20, 2013, which designates the United States; the entire contents of which are incorporated herein by reference.

FIELD

Embodiments described herein relate generally to a text-to-speech device, a text-to-speech method, and a computer program product.

BACKGROUND

A text-to-speech device is known that generates voice signals from input text. As one of the leading technologies used in text-to-speech devices, a text-to-speech technology based on the hidden Markov model (HMM) is known.

With the HMM-based text-to-speech technology, it is possible to generate voice signals that have voice quality of a desired speaker (target speaker) and desired speaking style (target speaking style). For example, it is possible to generate voice signals with a speaking style expressing the feeling of joy.

For generating voice signals having the target speaker's voice quality and target speaking style, there is a method to train an HMM in advance using the recorded voice samples uttered by the target speaker in the target speaking style, and then to use the trained HMM in synthesis time. However, this method requires a large cost for voice recording and phonetic labeling, since many utterances by the target speaker have to be recorded for all the target speaking styles.

Alternatively, regarding the method for generating voice signals having the target speaker's voice quality and the target speaking style, a method is known in which the voice signals having the target speaker's voice quality and a standard speaking style (i.e., a speaking style other than the target speaking style; for example, the speaking style of reading aloud in a calm manner) are modified with the characteristics of the target speaking style. Specific examples of this method include the two methods explained below.

In the first method, firstly, a standard speaking style HMM and a target speaking style HMM having the voice quality of the same speaker (a reference speaker) are created in advance. Then, using the voice samples uttered in the standard speaking style by the target speaker and the standard speaking style HMM having the reference speaker's voice quality, a new standard speaking style HMM having the target speaker's voice quality is created using the speaker adaptation technique. Moreover, using the correlation (the difference or the ratio) between the parameters of the standard speaking style HMM and the target speaking style HMM both having the reference speaker's voice quality, the standard speaking style HMM having the target speaker's voice quality is corrected to be a target speaking style HMM having the target speaker's voice quality. Then, voice signals having the target speaking style and the target speaker's voice quality are generated using the created target speaking style HMM having the target speaker's voice quality.

Meanwhile, characteristics in voice signals that are affected by the changes in the speaking style include globally-appearing characteristics and locally-appearing characteristics. The locally-appearing characteristics have context dependency that differs for each speaking style. For example, in speaking styles expressing the feeling of joy, the ending of words tends to have a rising pitch. On the other hand, in speaking styles expressing the feeling of sorrow, pauses tend to be longer. However, in the first embodiment, since the context dependency that differs for each speaking style is not taken into account, the locally-appearing characteristics of the target speaking style are difficult to be reproduced to a satisfactory extent.

In the second method, according to the cluster adaptive training (CAT), a statistical model that represents HMM parameters using linear combination of a plurality of cluster parameters is trained in advance using voice samples of a plurality of speakers with a plurality of speaking styles (including the standard speaking style and the target speaking style). Each cluster individually has a decision tree representing the context dependency. The combination of a particular speaker and a particular speaking style is expressed as a weight vector for making a linear combination of cluster parameters. A weight vector is formed by concatenating a speaker weight vector and a speaking style weight vector. In order to generate voice signals having the characteristics of the target speaker's voice quality and speaking style, firstly, CAT-based speaker adaptation is performed using the voice samples having the characteristics of the target speaker's voice quality and standard speaking style, and a speaker weight vector representing the target speaker is calculated. Then, the speaker weight vector representing the target speaker is concatenated with a speaking style vector representing the target speaking style calculated in advance to create a weight vector that represents the target speaking style having the target speaker's voice quality. Subsequently, using the created weight vector, voice signals having the target speaking style and target speaker's voice quality are generated.

In the second method, since each cluster individually has a decision tree, it becomes possible to reproduce the context dependency that differs for each speaking style. However, in the second method, the speaker adaptation needs to be performed in the CAT framework. Hence, as compared to the speaker adaptation performed according to the maximum likelihood linear regression (MLLR), it cannot reproduce the target speaker's voice quality precisely.

In this way, in the first method, since the context dependency that differs for each speaking style is not taken into account, the target speaking style cannot be reproduced to a satisfactory extent. Moreover, in the second method, since the CAT framework needs to be used for speaker adaptation, the target speaker's voice quality cannot be reproduced precisely.

DETAILED DESCRIPTION

Figure 1:
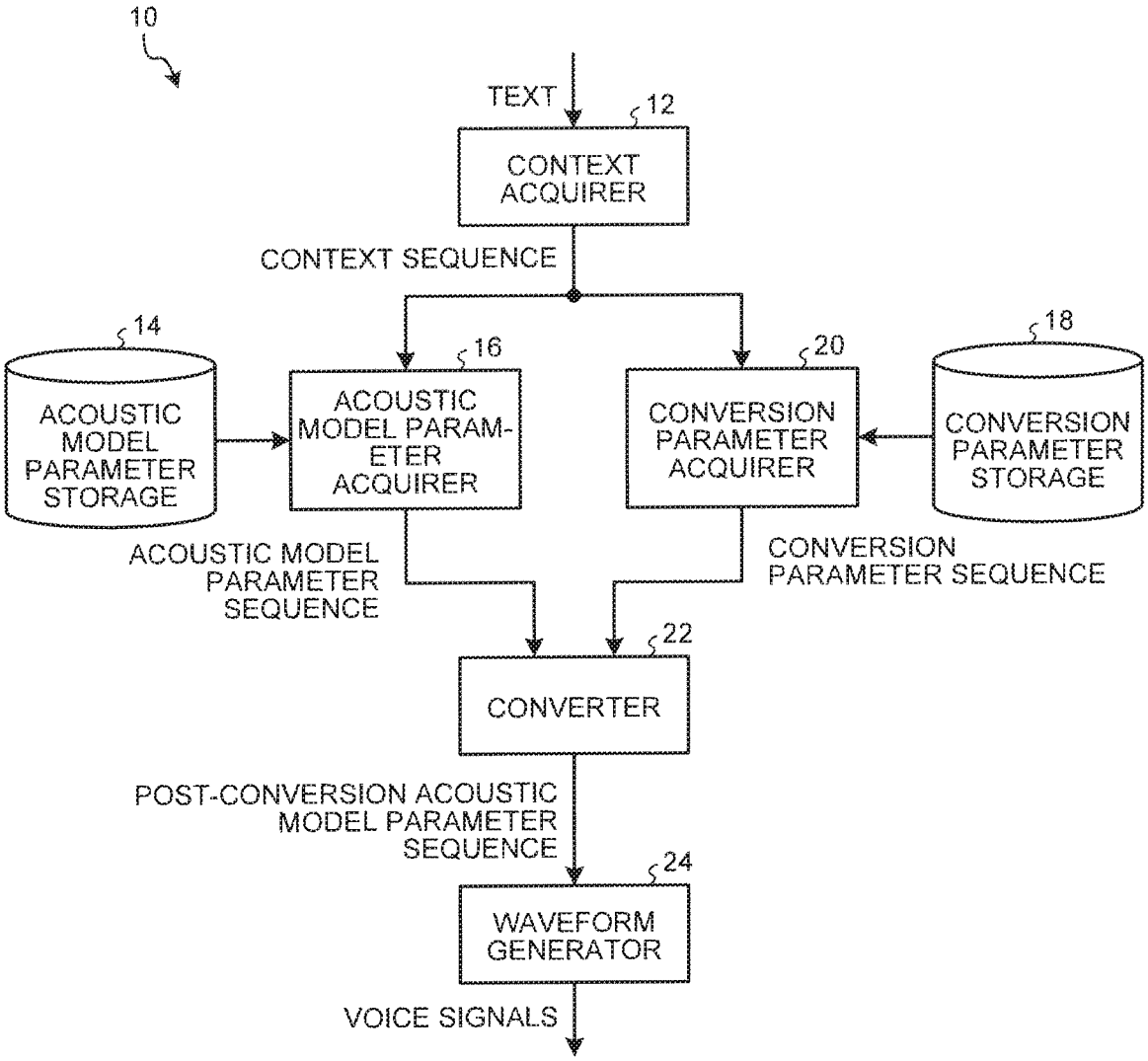
FIG. 1 is a diagram illustrating a configuration of a text-to-speech device according to a first embodiment.

According to an embodiment, a text-to-speech device includes a context acquirer, an acoustic model parameter acquirer, a conversion parameter acquirer, a converter, and a waveform generator. The context acquirer is configured to acquire a context sequence that is an information sequence affecting fluctuations in voice. The acoustic model parameter acquirer is configured to acquire an acoustic model parameter sequence that corresponds to the context sequence and represents an acoustic model in a standard speaking style of a target speaker. The conversion parameter acquirer is configured to acquire a conversion parameter sequence that corresponds to the context sequence and is used in converting an acoustic model parameter in the standard speaking style into one in a speaking style different from the standard speaking style. The converter is configured to convert the acoustic model parameter sequence using the conversion parameter sequence. The waveform generator is configured to generate a voice signal based on the acoustic model parameter sequence acquired after conversion.

Exemplary embodiments are described below in detail with reference to the accompanying drawings. In the embodiments described below, the constituent elements referred to by the same reference numerals perform substantially identical operations, and thus the redundant explanation excluding the differences is not repeated.

First Embodiment

FIG. 1 is a diagram illustrating a configuration of a text-to-speech device 10 according to the first embodiment. The text-to-speech device 10 according to the first embodiment outputs, according to an input text, voice signals having the characteristics of the voice quality of a particular speaker (the target speaker) and a particular speaking style (the target speaking style). Herein, the speaking style means the characteristics of a voice that change according to the content of the utterance and to the situation. Examples of the speaking style include the speaking style of reading aloud a text in a calm manner, the speaking style expressing the feeling of joy, the speaking style expressing the feeling of sorrow, and the speaking style expressing the feeling of anger.

The text-to-speech device 10 includes a context acquirer 12, an acoustic model parameter storage 14, an acoustic model parameter acquirer 16, a conversion parameter storage 18, a conversion parameter acquirer 20, a converter 22, and a waveform generator 24.

The context acquirer 12 receives input of a text. Then, the context acquirer 12 analyzes the input text by performing morphological analysis, and acquires a context sequence corresponding to the input text.

A context sequence is an information sequence affecting the fluctuations in voice, and includes at least a phoneme sequence. For example, the phoneme sequence can be a sequence of phonemes, such as diphones or triphones, expressed as combinations with the previous and the subsequent phonemes; or can be a sequence of half phonemes; or can be an information sequence in the units of syllables. Moreover, a context sequence may also include information such as the positions of phonemes in the text and the positions of accents.

Meanwhile, the context acquirer 12 can directly receive input of a context sequence instead of receiving input of a text. Alternatively, the context acquirer 12 can receive input of a text or a context sequence provided by the user, or can receive input of a text or a context sequence that is received from another device via a network.

The acoustic model parameter storage 14 stores information of an acoustic model created as a result of model training using the voice samples uttered by the target speaker in the standard speaking style (for example, the speaking style of reading aloud in a calm manner). The acoustic model information contains a plurality of acoustic model parameters classified according to the contexts as well as contains the first classification information used in determining the acoustic model parameters corresponding to a context.

An acoustic model is a probabilistic model representing the output probability of each phonetic parameter that indicates voice characteristics. In the first embodiment, the acoustic model is an HMM in which each state has phonetic parameters such as the fundamental frequency and a vocal tract parameter associated thereto. Moreover, the output probability distribution of each phonetic parameter is modeled using the Gaussian distribution. Meanwhile, when the acoustic model is a hidden semi-Markov model, the probability distribution of state durations is also modeled using the Gaussian distribution.

In the first embodiment, the acoustic model parameter includes a mean vector representing the mean of the output probability distribution of each phonetic parameter; and includes a covariance matrix representing the covariance of the output probability distribution of each phonetic parameter.

Moreover, in the first embodiment, a plurality of acoustic model parameters stored in the acoustic model parameter storage 14, are clustered based on a decision tree. Herein, the decision tree hierarchically divides the acoustic model parameters according to context-related questions. Each acoustic model parameter belongs to one of the leaves of the decision tree. In the first embodiment, the first classification information represents information for acquiring, from such a decision tree, a single acoustic model parameter corresponding to the input context.

Meanwhile, the acoustic model parameters stored in the acoustic model parameter storage 14 can be information created as a result of speaker-dependent model training using only the voice samples uttered by the target speaker. Alternatively, they can be information that is created, from an acoustic model created as a result of model training using the voices uttered by one or more speakers other than the target speaker, by performing speaker adaptation using the voice samples uttered by the target speaker. Such acoustic model parameters, when they are created by speaker adaptation, can be created using a relatively smaller amount of voice samples. Hence, the required cost is less while keeping high quality. Still alternatively, the acoustic model parameters stored in the acoustic model parameter storage 14 can be information created by model training in advance, or can be information calculated by speaker adaptation according to the maximum likelihood linear regression (MLLR) with the voice samples uttered by the target speaker.

The acoustic model parameter acquirer 16 acquires, from the acoustic model parameter storage 14, an acoustic model parameter sequence that corresponds to the context sequence and that represents the acoustic model of the standard speaking style of the target speaker. More particularly, based on the first classification information stored in the acoustic model parameter storage 14, the acoustic model parameter acquirer 16 determines the acoustic model parameter sequence corresponding to the context sequence acquired by the context acquirer 12.

In the first embodiment, for each context included in the context sequence that is input, the acoustic model parameter acquirer 16 tracks the decision tree from the root node to the leaves in a sequential manner according to the contents of the concerned context, and acquires a single acoustic model parameter belonging to the leaf that is reached. Then, the acoustic model parameter acquirer 16 concatenates the acquired acoustic model parameters in order in accordance with the context sequence and outputs the concatenation result as the acoustic model parameter sequence.

The conversion parameter storage 18 stores a plurality of conversion parameters classified according to the contexts and stores second classification information that is used in determining a single conversion parameter according to a context.

A conversion parameter represents information used in converting an acoustic model parameter of the standard speaking style into one of the target speaking style, which is different from the standard speaking style. For example, a conversion parameter is information used in converting the acoustic model parameter of the speaking style of reading aloud with neutral feeling into one having a speaking style expressing another feeling (such as the speaking style expressing the feeling of joy). More particularly, conversion parameters are used in changing the power, the formant, the pitch, and the rate of utterance, of the standard speaking style.

The conversion parameters stored in the conversion parameter storage 18 are created using voice samples uttered in the standard speaking style and ones uttered in the target speaking style by the same speaker.

For example, a conversion parameter stored in the conversion parameter storage 18 is created in the following manner. Firstly, using the voice samples of standard speaking style by a particular speaker, the standard speaking style HMM is trained. Then, a conversion parameter is optimized so that, when the standard speaking style HMM is converted using that conversion parameter, the converted HMM should give the maximum likelihood for the voice samples uttered in the target speaking style by the target speaker. Meanwhile, in the case of using a parallel corpus of voices in which the same text is uttered both in the standard speaking style and the target speaking style, the conversion parameters can also be created from the phonetic parameters of the concerned standard speaking style and ones of the target speaking style.

Alternatively, a conversion parameter that is stored in the conversion parameter storage 18 can be created as a result of model training using the voice samples uttered by a different speaker from the target speaker. Still alternatively, a conversion parameter that is stored in the conversion parameter storage 18 can be an average parameter created using voice samples uttered in the standard speaking style and the target speaking style by a plurality of speakers.

Still alternatively, in the first embodiment, a conversion parameter can be a vector having an identical dimensionality to the mean vector included in the acoustic model parameters. In that case, the conversion parameter can be a difference vector representing the difference between the mean vector included in the acoustic model parameters of the standard speaking style and the one of the target speaking style. As a result, when the conversion parameter is added to the mean vector of the standard speaking style, the mean vector of the standard speaking style can be converted into the one of the target speaking style.

Meanwhile, in the first embodiment, a plurality of conversion parameters stored in the conversion parameter storage 18 is clustered based on a decision tree. Herein, the decision tree hierarchically divides the conversion parameters according to context-related questions. Each conversion parameter belongs to one of the leaves of the decision tree. In the present embodiment, the second classification information represents information for acquiring, from such a decision tree, a single conversion parameter corresponding to the input context.

Figure 2:
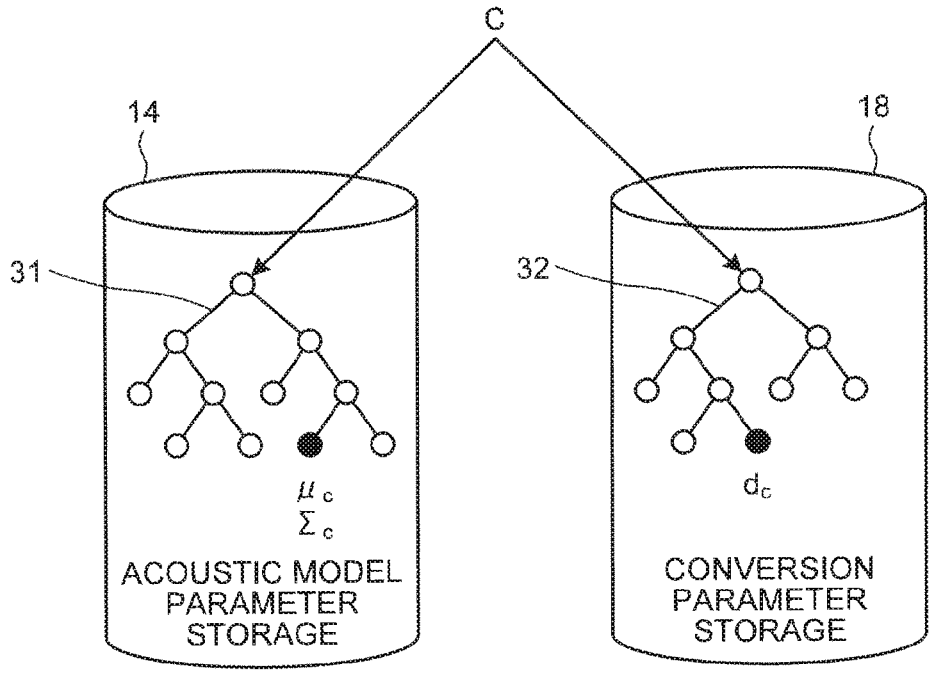
FIG. 2 is a diagram illustrating acoustic model parameters subjected to decision tree clustering.

Herein, the decision tree used in classifying a plurality of conversion parameters stored in the conversion parameter storage 18 is not restricted to the decision tree used in classifying the acoustic model parameters stored in the acoustic model parameter storage 14. For example, as illustrated in FIG. 2, the decision tree 31 in the acoustic model parameter storage 14 can have a different tree structure from the one in the conversion parameter storage 18. Thus, when a particular context c is provided, the position of the leaf that the acoustic model parameters for the context c (i.e., a mean vector $\mu_c$ and a covariance matrix $\Sigma_c$) belong to, can be different from the one that the conversion parameter for the context c (i.e., a difference vector $d_c$) belongs to. As a result, in the text-to-speech device 10, the context dependency of the target speaking style can be precisely reflected in the voice signals generated by converting the speaking style; and the target speaking style can be reproduced precisely. Thus, for example, in the text-to-speech device 10, it becomes possible to accurately reproduce the context dependency, such as the rising pitch at the ending of words in the speaking style expressing the feeling of joy.

The conversion parameter acquirer 20 acquires, from the conversion parameter storage 18, a conversion parameter sequence to be used in converting acoustic model parameters in the standard speaking style into ones in a speaking style other than the standard speaking style. More particularly, based on the second classification information stored in the conversion parameter storage 18, the conversion parameter acquirer 20 determines a conversion parameter sequence corresponding to the context sequence acquired by the context acquirer 12.

In the present embodiment, regarding each context included in the context sequence that is input, the conversion parameter acquirer 20 tracks the decision tree from the root node to the leaves in a sequential manner according to the contents of the concerned context, and acquires a single conversion parameter belonging to the leaf that is reached. Then, the conversion parameter acquirer 20 concatenates the acquired conversion parameters in order of the context sequence and outputs the concatenation result as the conversion parameter sequence.

Meanwhile, with respect to the same context sequence, the acoustic model parameter sequence, which is output by the acoustic model parameter acquirer 16, has an identical length to the conversion parameter sequence, which is output by the conversion parameter acquirer 20. Moreover, the acoustic model parameters that are included in the acoustic model parameter sequence, which is output by the acoustic model parameter acquirer 16, have a one-to-one correspondence with the conversion parameters that are included in the conversion parameter sequence, which is output by the conversion parameter acquirer 20.

The converter 22 makes use of the conversion parameter sequence acquired by the conversion parameter acquirer 20 and converts the acoustic model parameter sequence, which is acquired by the acoustic model parameter acquirer 16, into acoustic model parameters of a different speaking style from the standard speaking style. As a result, the converter 22 can generate an acoustic model parameter sequence that represents the acoustic model of the target speaker's voice quality and the target speaking style.

In the first embodiment, the converter 22 adds to each mean vector included in the acoustic model parameter sequence, a conversion parameter (a difference vector) included in the conversion parameter sequence to generate a post-conversion acoustic model parameter sequence.

Figure 3:
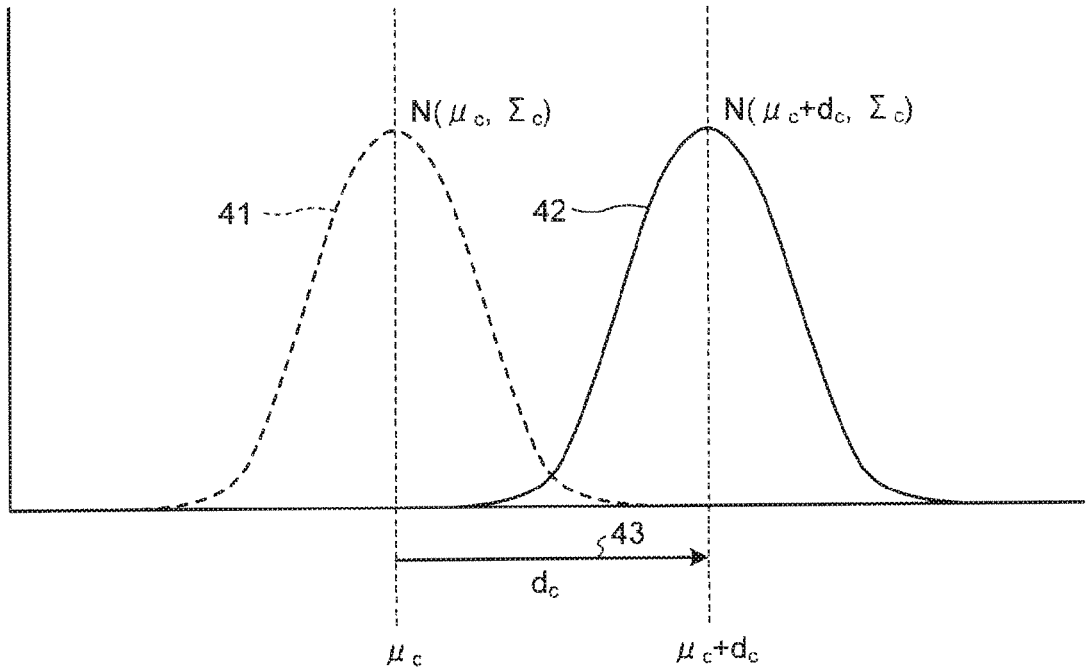
FIG. 3 is a diagram illustrating an example of conversion of an output probability distribution.

For example, FIG. 3 illustrates an example of conversion performed when the mean vectors of acoustic model parameters are one-dimensional. Herein, it is assumed that a probability density function 41 of the standard speaking style has the mean vector $\mu_c$ and the covariance matrix $\Sigma_c$. Moreover, it is assumed that $d_c$ represents a difference vector 43 included in a conversion parameter. In this case, the converter 22 adds to each mean vector $\mu_c$ included in the acoustic model parameter sequence, the corresponding difference vector $d_c$ included in the conversion parameter sequence. As a result, the converter 22 can convert the probability density function 41 ($N(\mu_c, \Sigma_c)$) of the standard speaking style into a probability density function 42 ($N(\mu_c+d_c, \Sigma_c)$) of the target speaking style.

Meanwhile, alternatively, the converter 22 can perform constant multiplication of the difference vectors before adding them to the mean vectors. As a result, the converter 22 can control the degree of speaking style conversion. That is, the converter 22 can ensure the output of such voice signals in which the degree of joy or the degree of sorry is varied. Meanwhile, the converter 22 can vary the speaking style with respect to a particular portion in a text, or can gradually vary the degree of the speaking style within a text.

The waveform generator 24 generates voice signals based on the acoustic model parameter sequence that has been converted by the converter 22. As an example, firstly, from the post-conversion acoustic model parameter sequence (for example, a sequence of mean vectors and covariance matrices), the waveform generator 24 generates a phonetic parameter sequence (for example, a sequence of fundamental frequencies and vocal tract parameters) according to the maximum likelihood method. Then, as an example, according to each phonetic parameter included in the phonetic parameter sequence, the waveform generator 24 controls the corresponding signal source and a filter, and generates a voice signal.

Figure 4:
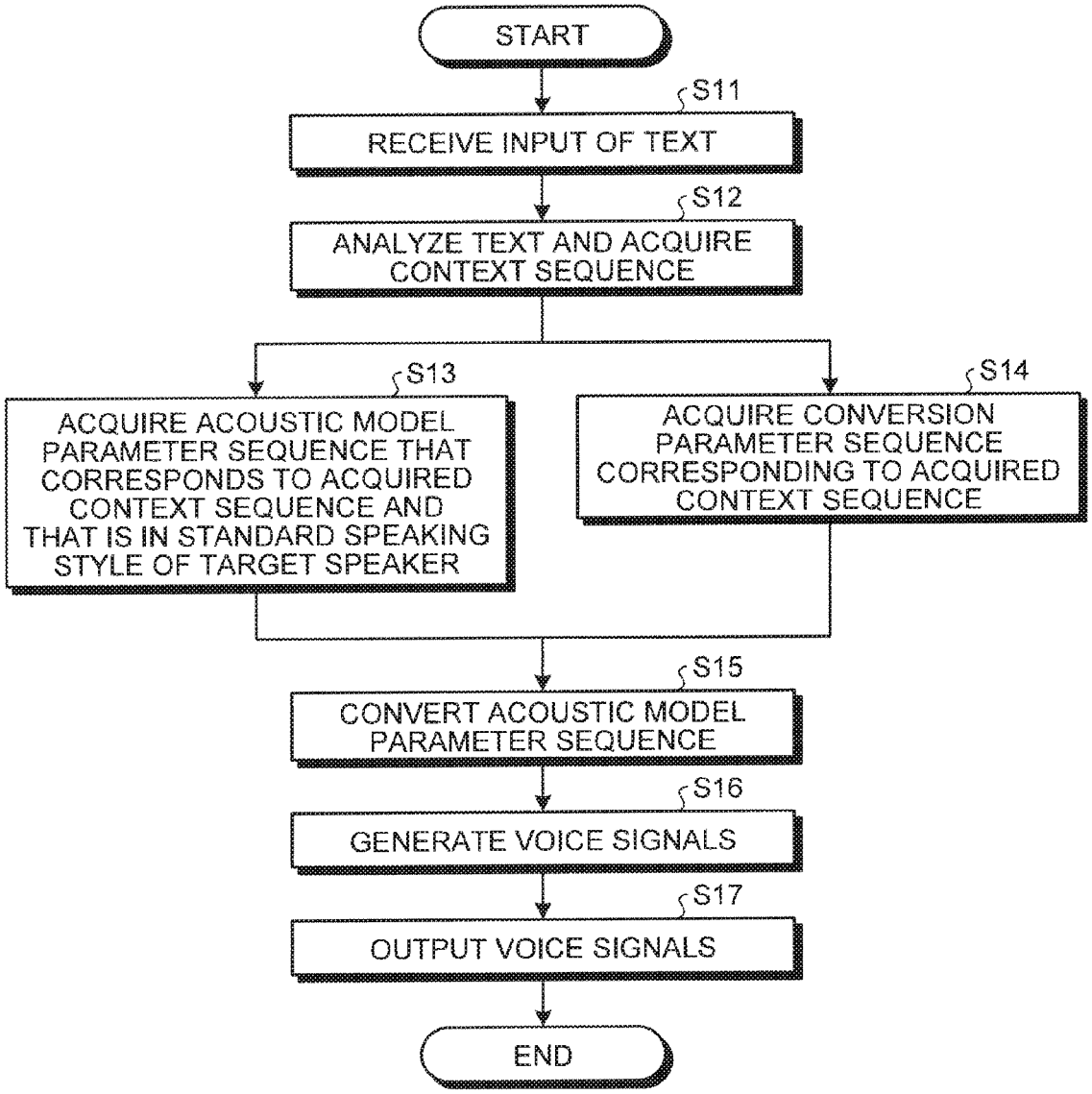
FIG. 4 is a flowchart for explaining the operations performed in the text-to-speech device according to the first embodiment.

FIG. 4 is a flowchart for explaining the operations performed in the text-to-speech device 10 according to the first embodiment. Firstly, at Step S11, the text-to-speech device 10 receives input of a text. Then, at Step S12, the text-to-speech device 10 analyzes the text and acquires a context sequence.

Subsequently, at Step S13, the text-to-speech device 10 acquires, from the acoustic model parameter storage 14, the acoustic model parameter sequence that corresponds to the acquired context sequence and that is in the standard speaking style of the target speaker. More particularly, based on the first classification information, the text-to-speech device 10 determines the acoustic model parameter sequence corresponding to the acquired context sequence.

In parallel to Step S13, at Step S14, the text-to-speech device 10 acquires, from the conversion parameter storage 18, a conversion parameter sequence to be used in converting the acoustic model parameters that correspond to the acquired context sequence and that are in the standard speaking style, into acoustic model parameters in a different speaking style from the standard speaking style. More particularly, based on the second classification information, the text-to-speech device 10 determines a conversion parameter sequence corresponding to the acquired context sequence.

Then, at Step S15, the text-to-speech device 10 makes use of the conversion parameter sequence and converts the acoustic model parameter sequence in the standard speaking style into ones of a different speaking style from the standard speaking style. Subsequently, at Step S16, the text-to-speech device 10 generates voice signals based on the post-conversion acoustic model parameter sequence. Then, at Step S17, the text-to-speech device 10 outputs the generated voice signals.

In this way, in the text-to-speech device 10 according to the first embodiment, conversion parameters classified according to contexts are used in converting the acoustic model parameter sequence that represents an acoustic model in the standard speaking style of the target speaker, and generates acoustic model parameters in the target speaking style of the target speaker. As a result, in the text-to-speech device 10 according to the first embodiment, it becomes possible to generate highly precise voice signals which have the characteristics of the target speaker's voice quality and the target speaking style and which the context dependency is also reflected to.

Second Embodiment

Figure 5:
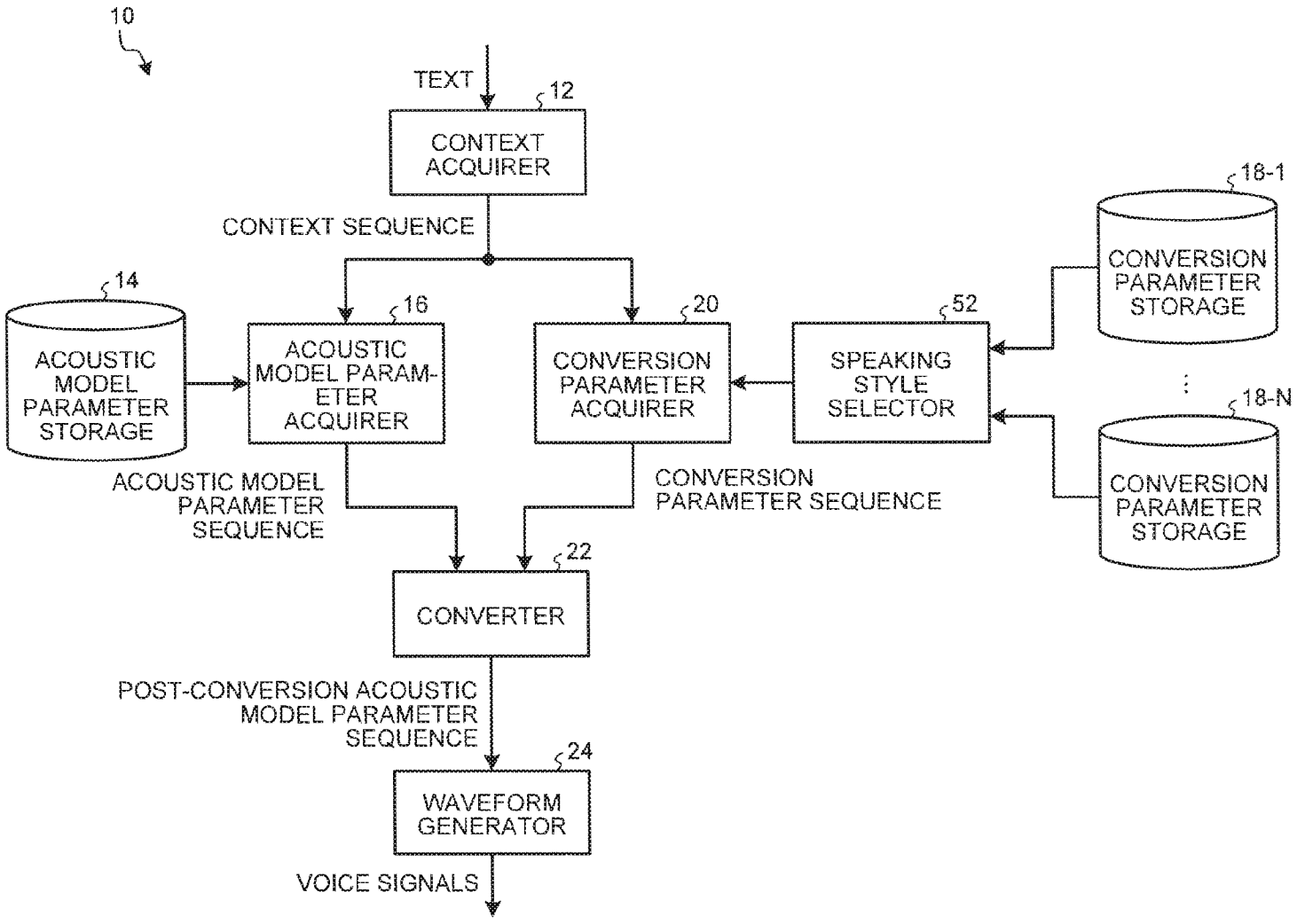
FIG. 5 is a diagram illustrating a configuration of the text-to-speech device according to a second embodiment.

FIG. 5 is a diagram illustrating a configuration of the text-to-speech device 10 according to a second embodiment. As compared to the configuration illustrated in FIG. 1 according to the first embodiment, the text-to-speech device 10 according to the second embodiment includes a plurality of conversion parameter storages 18 (18-1, . . . , 18-N) in place of the conversion parameter storage 18 and further includes a speaking style selector 52.

The conversion parameter storages 18-1, . . . , 18-N store conversion parameters corresponding to mutually different speaking styles. Herein, as long as the number of conversion parameter storages 18 disposed in the text-to-speech device 10 according to the second embodiment is equal to or greater than two, there is no restriction on the number.

For example, the first conversion parameter storage 18-1 stores a conversion parameter to be used in converting the acoustic model parameters of the standard speaking style (the speaking style of reading aloud with neutral feeling) into ones expressing the feeling of joy. Moreover, the second conversion parameter storage 18-2 stores a conversion parameter to be used in converting the acoustic model parameter of the standard speaking style into ones expressing the feeling of sorrow. Furthermore, the third conversion parameter storage 18-3 stores a conversion parameter to be used in converting the acoustic model parameter of the standard speaking style into ones expressing the feeling of anger.

The speaking style selector 52 selects one of the plurality of conversion parameter storages 18. Herein, the speaking style selector 52 can select the conversion parameter storage 18 corresponding to the speaking style specified by the user, or can estimate an appropriate speaking style from the contents of the text and select the conversion parameter storage 18 corresponding to the estimated speaking style. Then, the conversion parameter acquirer 20 acquires, from the conversion parameter storage 18 selected by the speaking style selector 52, the conversion parameter sequence corresponding to the context sequence. As a result, the text-to-speech device 10 can output voice signals of the appropriate speaking style selected from among a plurality of speaking styles.

Meanwhile, the speaking style selector 52 can select two or more conversion parameter storages 18 from among a plurality of conversion parameter storages 18. In that case, from each of the two or more conversion parameter storages 18 that are selected, the conversion parameter acquirer 20 acquires the conversion parameter sequence corresponding to the context sequence.

Then, the converter 22 converts the acoustic model parameter sequence, which is acquired by the acoustic model parameter acquirer 16, using two or more conversion parameters sequences acquired by the conversion parameter acquirer 20.

For example, the converter 22 converts the acoustic model parameter sequence using the mean of two or more conversion parameters. As a result, in the text-to-speech device 10, for example, it becomes possible to generate voice signals of a speaking style having a mixture of the feeling of joy and the feeling of sorrow. Alternatively, the converter 22 can convert the acoustic model parameter sequence using conversion parameters each corresponding to a different speaking style for each portion in the text. As a result, the text-to-speech device 10 can output voice signals having a different speaking style for each portion in the text.

Meanwhile, each of a plurality of conversion parameter storages 18 can store conversion parameters that are trained from the voice samples uttered by a plurality of different speakers in the same type of speaking style as the target speaking style. Even if the speaking style is of the same type, the expression of that speaking style is little bit different for each speaker. Thus, the text-to-speech device 10 can select the conversion parameters trained from the voice samples uttered by different speakers in the same type of speaking style, and can output more accurate voice signals.

In this way, in the text-to-speech device 10 according to the second embodiment, an acoustic model parameter sequence can be converted using conversion parameters corresponding to a plurality of speaking styles. As a result, in the text-to-speech device 10 according to the second embodiment, it becomes possible to output voice signals of the user-selected speaking style, or to output voice signals of the most suitable speaking style according to the text contents, or to output voice signals including switching of the speaking styles or including mixtures of multiple speaking styles.

Third Embodiment

Figure 6:
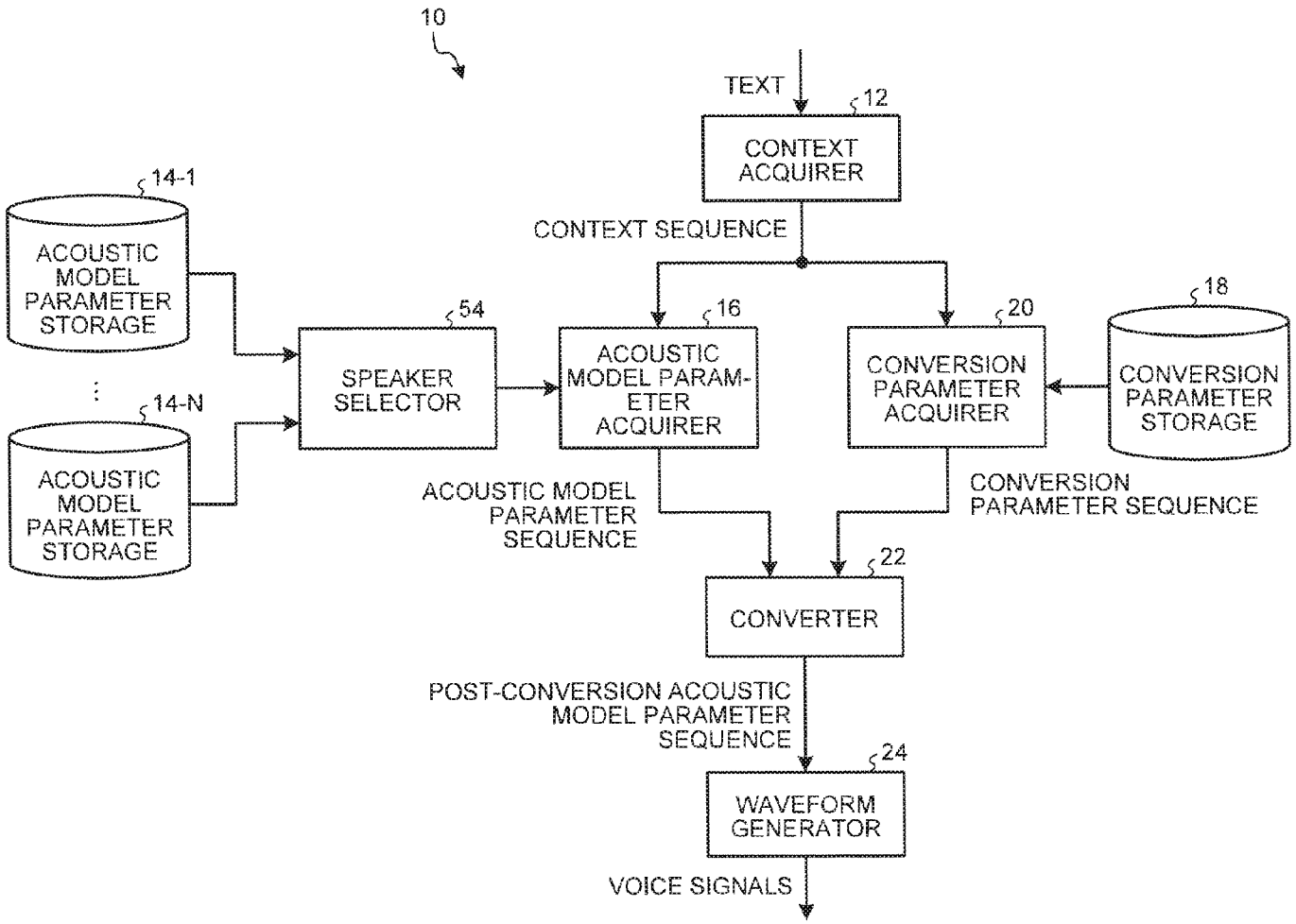
FIG. 6 is a diagram illustrating a configuration of the text-to-speech device according to a third embodiment.

FIG. 6 is a diagram illustrating a configuration of the text-to-speech device 10 according to a third embodiment. As compared to the configuration illustrated in FIG. 1 according to the first embodiment, the text-to-speech device 10 according to the third embodiment includes a plurality of acoustic model parameter storages 14 (14-1, . . . , 14-N) in place of the single acoustic model parameter storage 14, and further includes a speaker selector 54.

The acoustic model parameter storages 14 store acoustic model parameters corresponding to mutually different speakers. That is, each acoustic model parameter storage 14 stores an acoustic model parameter trained from the voice samples uttered in the standard speaking style by each of different speakers. Herein, as long as the number of acoustic model parameter storages 14 disposed in the text-to-speech device 10 according to the third embodiment is equal to or greater than two, there is no other restriction on the number.

The speaker selector 54 selects one of the plurality of acoustic model parameter storages 14. For example, the speaker selector 54 selects the acoustic model parameter storage 14 corresponding to the speaker specified by the user. The acoustic model parameter acquirer 16 acquires, from the acoustic model parameter storage 14 selected by the speaker selector 54, the acoustic model parameter sequence corresponding to the context sequence.

In this way, in the text-to-speech device 10 according to the third embodiment, the acoustic model parameter sequence of the concerned speaker can be selected from among a plurality of acoustic model parameter storages 14. As a result, in the text-to-speech device 10 according to the third embodiment, a speaker can be selected from among a plurality of speakers, and voice signals having the voice quality of the selected speaker can be generated.

Fourth Embodiment

Figure 7:
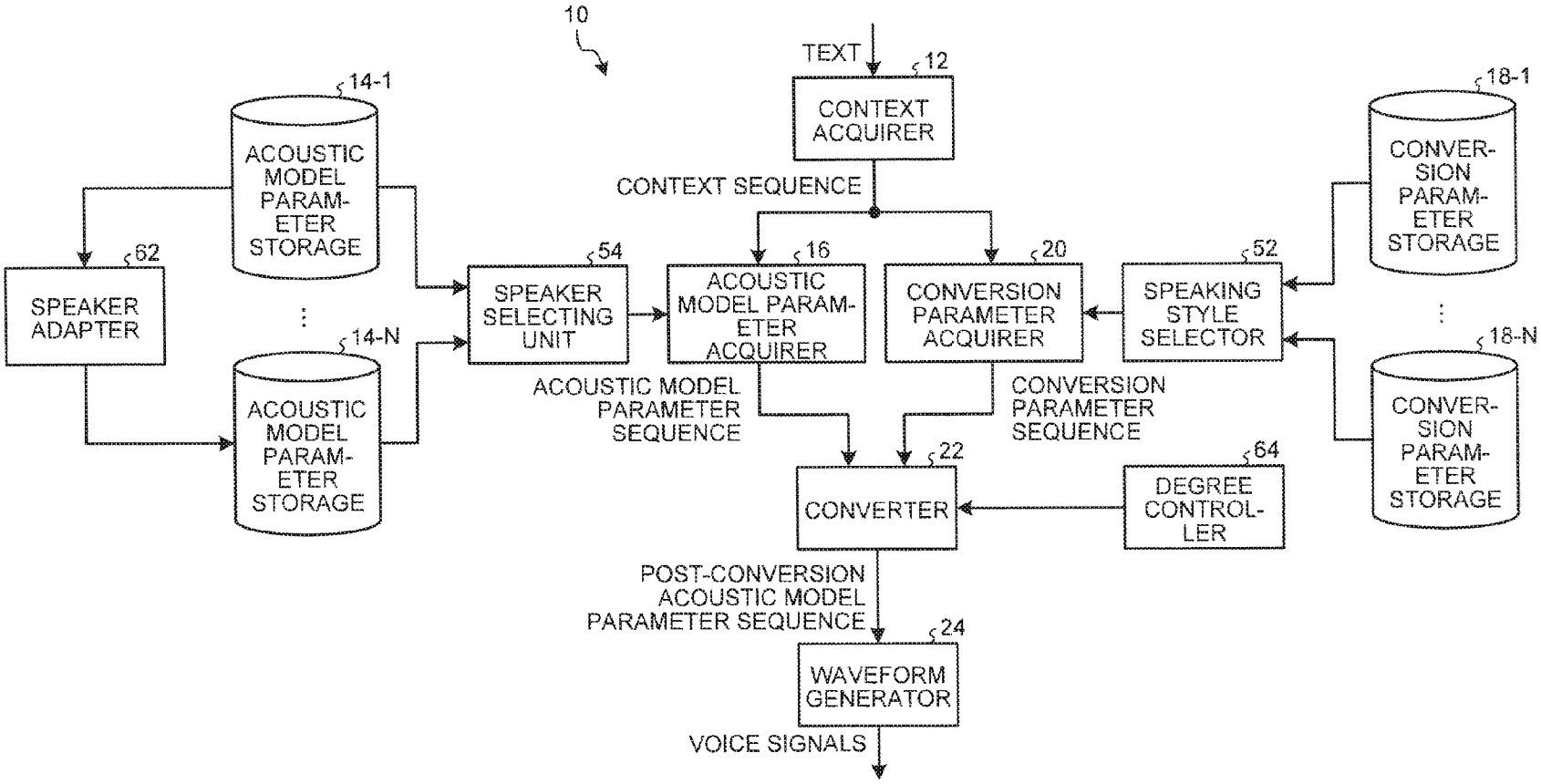
FIG. 7 is a diagram illustrating a configuration of the text-to-speech device according to a fourth embodiment.

FIG. 7 is a diagram illustrating a configuration of the text-to-speech device 10 according to a fourth embodiment. As compared to the configuration illustrated in FIG. 1 according to the first embodiment, the text-to-speech device 10 according to the fourth embodiment includes a plurality of acoustic model parameter storages 14 (14-1, . . . , 14-N) in place of the single acoustic model parameter storage 14; includes the speaker selector 54; includes a plurality of conversion parameter storages 18 (18-1, . . . , 18-N) in place of the single conversion parameter storage 18; includes the speaking style selector 52; and further includes a speaker adapter 62 and a degree controller 64.

The acoustic model parameter storages 14 (14-1, . . . , 14-N) and the speaker selector 54 are identical to the third embodiment. Moreover, the conversion parameter storages 18 (18-1, . . . , 18-N) and the speaking style selector 52 are identical to the second embodiment.

The speaker adapter 62 converts the acoustic model parameters stored in a particular acoustic model parameter storage 14 into ones corresponding to a specific speaker using speaker adaptation. For example, when a specific speaker is selected, the speaker adapter 62 generates acoustic model parameters corresponding to the selected speaker using speaker adaptation based on the voice signals uttered in the standard speaking style by the selected specific speaker and on the acoustic model parameters stored in a particular acoustic model parameter storage 14. Then, the speaker adapter 62 writes the acquired acoustic model parameters to the acoustic model parameter storage 14 for the selected specific speaker.

The degree controller 64 controls the ratios at which the conversion parameters acquired from two or more conversion parameter storages 18 selected by the speaking style selector 52 are to be reflected in the acoustic model parameters. For example, consider a case in which the conversion parameter of the speaking style expressing the feeling of joy and the conversion parameter of the speaking style expressing the feeling of sorrow are selected. When the feeling of joy are to be stressed upon, the degree controller 64 increases the percentage of the conversion parameter for the feeling of joy and reduces the percentage of the conversion parameter for the feeling of sorrow. Then, according to the ratios controlled by the degree controller 64, the converter 22 mixes the conversion parameters acquired from two or more conversion parameter storages 18, and converts the acoustic model parameters using the mixed conversion parameter.

In this way, in the text-to-speech device 10 according to the fourth embodiment, speaker adaptation is performed, and acoustic model parameters of a specific speaker are generated. As a result, in the text-to-speech device 10 according to the fourth embodiment, by acquiring only a relatively small amount of voices of a specific speaker, acoustic model parameters corresponding to the specific speaker can be created. Thus, in the text-to-speech device 10 according to the fourth embodiment, precise voice signals can be generated with less cost. Moreover, in the text-to-speech device 10 according to the fourth embodiment, since the ratio of two or more conversion parameters is controlled, it becomes possible to appropriately control the ratio of a plurality of feelings included in the voice signals.

Hardware Configuration

Figure 8:
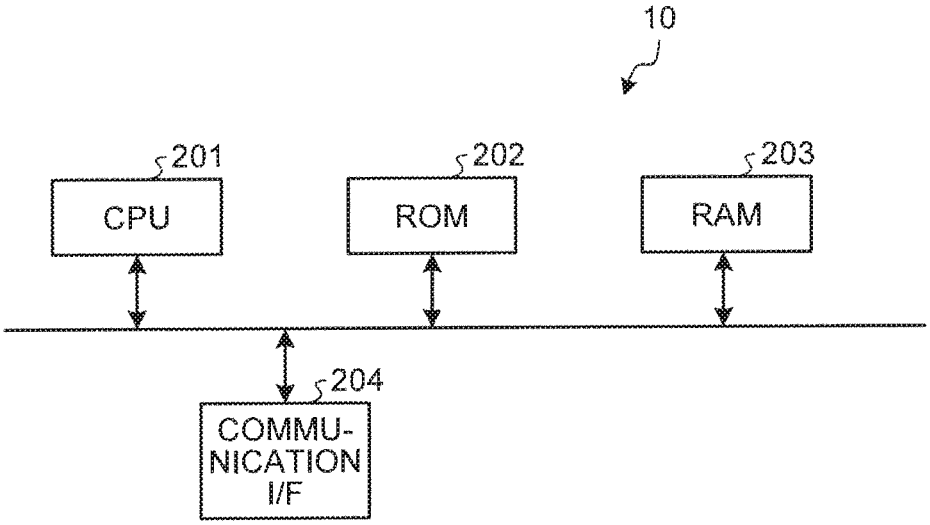
FIG. 8 is a diagram illustrating a hardware block of the text-to-speech device.

FIG. 8 is a diagram illustrating an exemplary hardware configuration of the text-to-speech device 10 according to the first to fourth embodiments. The text-to-speech device 10 according to the first to fourth embodiments includes a controller such as a CPU (Central Processing Unit) 201, memory devices such as a ROM (Read Only Memory) 202 and a RAM (Random Access Memory) 203, a communication I/F 204 that establishes connection with a network and performs communication, and a bus that connects the constituent elements to each other.

A program executed in the text-to-speech device 10 according to the embodiments is stored in advance in the ROM 202. Alternatively, the program executed in the text-to-speech device 10 according to the embodiments can be recorded as an installable file or an executable file in a computer-readable recording medium such as a CD-ROM (Compact Disk Read Only Memory), a flexible disk (FD), a CD-R (Compact Disk Recordable), or a DVD (Digital Versatile Disk); and can be provided as a computer program product.

Still alternatively, the program executed in the text-to-speech device 10 according to the embodiments can be stored in a computer connected to a network such as the Internet, and can be downloaded by the text-to-speech device 10 via the network. Still alternatively, the program executed in the text-to-speech device 10 according to the embodiments can be distributed via a network such as the Internet.

The program executed in the text-to-speech device 10 according to the embodiments contains a context acquiring module, an acoustic model parameter acquiring module, a conversion parameter acquiring module, a converting module, and a waveform generating module. Thus, the computer can be made to function as the constituent elements of the text-to-speech device 10 (i.e., the context acquirer 12, the acoustic model parameter acquirer 16, the conversion parameter acquirer 20, the converter 22, and the waveform generator 24). In the computer, the CPU 201 can read the program from a computer-readable memory medium into a main memory device, and can execute the program. Meanwhile, some or all of the context acquirer 12, the acoustic model parameter acquirer 16, the conversion parameter acquirer 20, the converter 22, and the waveform generator 24 can be configured using hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A text-to-speech device comprising:

one or more processors configured to:

acquire a context sequence that is an information sequence affecting fluctuations in voice;

acquire an acoustic model parameter sequence corresponding to the context sequence, the acoustic model parameter sequence representing a standard speaking style of a target speaker;

acquire a conversion parameter sequence corresponding to the context sequence, the conversion parameter sequence being used in converting an acoustic model parameter in the standard speaking style into one in a speaking style different from the standard speaking style;

convert the acoustic model parameter sequence using the conversion parameter sequence; and generate a voice signal based on the acoustic model parameter sequence acquired after conversion.

2. The device according to claim 1, wherein the context sequence includes at least a phoneme sequence.

3. The device according to claim 1, further comprising:

an acoustic model parameter storage configured to store a plurality of acoustic model parameters classified according to contexts and store first classification information used in determining one of the acoustic model parameters corresponding to a given context; and a conversion parameter storage configured to store a plurality of conversion parameters classified according to contexts and store second classification information used in determining one of the conversion parameters corresponding to a given context, wherein the one or more processors is configured to:

determine, based on the first classification information stored in the acoustic model parameter storage, the acoustic model parameter sequence corresponding to the acquired context sequence, and determine, based on the second classification information stored in the conversion parameter storage, the conversion parameter sequence corresponding to the acquired context sequence.

4. The device according to claim 3, wherein the conversion parameter is created using voice samples uttered by a certain speaker in a standard speaking style and voice samples uttered by the same speaker in a different speaking style from the standard speaking style.

5. The device according to claim 3, wherein the acoustic model parameter is created using voice samples uttered by the target speaker, and the conversion parameter is created using voice samples uttered by a speaker different from the target speaker.

6. The device according to claim 3, wherein the acoustic model parameter is created using voice samples uttered by the target speaker in a speaking style expressing neutral feeling, and the conversion parameter represents information used in converting an acoustic model parameter of the speaking style expressing neutral feeling into one expressing a feeling other than neutral.

7. The device according to claim 1, wherein the acoustic model is a probabilistic model in which output probabilities of respective phonetic parameters that represent characteristics of a voice are expressed using Gaussian distribution, the acoustic model parameter includes a mean vector representing a mean of an output probability distribution of each phonetic parameter, the conversion parameter represents a vector having the same dimensionality as the mean vector included in the acoustic model parameter, and the one or more processors is further configured to add a conversion parameter included in the conversion parameter sequence to a mean vector included in the acoustic model parameter sequence to generate a post-conversion acoustic model parameter sequence.

8. The device according to claim 1, further comprising:

a plurality of conversion parameter storages configured to store conversion parameters corresponding to mutually different speaking styles, wherein the one or more processors is further configured to:

select one of the plurality of conversion parameter storages, and acquire the conversion parameter sequence from the selected conversion parameter storage.

9. The device according to claim 1, further comprising:

a plurality of conversion parameter storages configured to store conversion parameters corresponding to mutually different speaking styles, wherein the one or more processors is further configured to:

select two or more of the plurality of conversion parameter storages, wherein acquire the conversion parameter sequence from each of the selected two or more conversion parameter storages, and convert the acoustic model parameter sequence using the two or more conversion parameter sequences.

10. The device according to claim 9, wherein the one or more processors is further configured to:

control ratios at which the respective conversion parameters acquired from the selected two or more of the conversion parameter storages are to be reflected in the acoustic model parameters.

11. The device according to claim 1, further comprising:

a plurality of acoustic model parameter storages configured to store the acoustic model parameters corresponding to mutually different speakers, wherein the one or more processors is further configured to:

select one of the plurality of acoustic model parameter storages, and acquire the acoustic model parameter sequence from the selected acoustic model parameter storage.

12. The device according to claim 11, wherein the one or more processors is further configured to convert the acoustic model parameter stored in one of the acoustic model parameter storages into the acoustic model parameter corresponding to a specific speaker using speaker adaptation, and write the acoustic model parameter acquired by conversion in the acoustic model parameter storage corresponding to the specific speaker.

13. A text-to-speech method comprising:

acquiring by one or more processors, a context sequence that is an information sequence affecting fluctuations in voice;

acquiring by the one or more processors, an acoustic model parameter sequence corresponding to the context sequence, the acoustic model parameter sequence representing an acoustic model in a standard speaking style of a target speaker;

acquiring by the one or more processors, a conversion parameter sequence corresponding to the context sequence, the conversion parameter sequence being used in converting an acoustic model parameter in the standard speaking style into one in a speaking style different from the standard speaking style;

converting by the one or more processors, the acoustic model parameter sequence using the conversion parameter sequence; and generating by the one or more processors, a voice signal based on the acoustic model parameter sequence acquired after conversion.

14. A computer program product comprising a non-transitory computer-readable medium containing a program executed by a computer, the program causing the computer to execute:

acquiring a context sequence that is an information sequence affecting fluctuations in voice;

acquiring an acoustic model parameter sequence corresponding to the context sequence, the acoustic model parameter sequence representing an acoustic model in a standard speaking style of a target speaker;

acquiring a conversion parameter sequence corresponding to the context sequence, the conversion parameter sequence being used in converting an acoustic model parameter in the standard speaking style into one in a speaking style different from the standard speaking style;

converting the acoustic model parameter sequence using the conversion parameter sequence; and generating a voice signal based on the acoustic model parameter sequence acquired after conversion.

* * * * *